US005733700A

United States Patent [19]

Asano et al.

[11] Patent Number: 5,733,700

[45] Date of Patent: Mar. 31, 1998

[54] ENCAPSULATED TONER FOR HEAT-AND-PRESSURE FIXING AND METHOD FOR PRODUCTION THEREOF

[75] Inventors: Tetsuya Asano; Mitsuhiro Sasaki; Kuniyasu Kawabe, all of Wakayama, Japan

[73] Assignee: Kao Corporation, Tokyo, Japan

[21] Appl. No.: 784,357

[22] Filed: Jan. 17, 1997

Related U.S. Application Data

[63] Continuation of Ser. No. 98,882, Jul. 29, 1993, abandoned.

[30] Foreign Application Priority Data

Aug. 11, 1992 [JP] Japan ..... 4-236370

[51] Int. Cl.[6] ..... G03G 9/00

[52] U.S. Cl. ..... 430/109; 430/137; 430/138

[58] Field of Search ..... 430/109, 137, 430/138

[56] References Cited

U.S. PATENT DOCUMENTS

| | | | |
|---|---|---|---|
| 4,450,221 | 5/1984 | Terada et al. | 430/138 |
| 4,888,264 | 12/1989 | Matsumoto et al. | 430/137 |

FOREIGN PATENT DOCUMENTS

| | | |
|---|---|---|
| 2573224 | 8/1985 | France . |
| 55-89854 | 7/1980 | Japan . |
| 60-69659 | 4/1985 | Japan . |
| 61-56352 | 3/1986 | Japan . |
| 62-280758 | 12/1987 | Japan . |
| 63-128357 | 5/1988 | Japan . |
| 4-16856 | 1/1992 | Japan . |
| 4-130327 | 5/1992 | Japan . |

OTHER PUBLICATIONS

Patent Abstracts of Japan, vol. 8, No. 151 (P–286) (1588), 13 Jul. 1984 & JP–A–59 048 772.

Patent Abstracts of Japan, vol. 9, No. 207 (P–382) 24 Aug. 1985 & JP–A–60 069 659.

Database WPI, Week 8445, Derwent Publications Ltd. AN 84–278570 (45) & JP–A–59 170 856.

Patent Abstracts of Japan, vol. 10, No. 220 (P–482) (2276) 31 Jul. 1986 & JP–A–61 056 352.

*Primary Examiner*—George F. Lesmes
*Assistant Examiner*—Laura Weiner
*Attorney, Agent, or Firm*—Birch, Stewart, Kolasch & Birch, LLP

[57] ABSTRACT

The present invention is directed to an encapsulated toner for heat-and-pressure fixing whose shell contains a copolymer having one or more acid anhydride groups as the main component. The encapsulated toner of the present invention has excellent offset resistance and fixing ability even at a low fixing temperature, and also it is excellent in blocking resistance. Further, since the resin having a negative charge is used as a shell material, clear images free from background contamination can be stably formed for a large number of copying.

10 Claims, No Drawings

ENCAPSULATED TONER FOR HEAT-AND-PRESSURE FIXING AND METHOD FOR PRODUCTION THEREOF

This application is a continuation, of application Ser. No. 08/098,882 filed on Jul. 29, 1993, now abandoned.

FIELD OF THE INVENTION

The present invention relates to an encapsulated toner for heat-and-pressure fixing used in electrostatic image development in electrophotography, electrostatic printing, electrostatic recording, etc. and a method for production of such an encapsulated toner.

BACKGROUND OF THE INVENTION

As described in U.S. Pat. Nos. 2,297,691 and 2,357,809 and other publications, conventional electrophotography comprises the steps of forming an electrostatic latent image by evenly charging a photoconductive insulating layer and subsequently exposing the layer to eliminate the charge in the exposed portion and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

As stated above, a toner must meet the requirements not only in the development process but also in the transfer process and fixing process.

Generally, a toner undergoes mechanical frictional forces due to shear force and impact force during the mechanical operation in a developer device, thereby deteriorating after copying from several thousand to several tens of thousand sheets. Such deterioration of the toner can be prevented by using a tough resin having such a high molecular weight that it can withstand the above mechanical friction. However, this kind of a resin generally has such a high softening point that the resulting toner cannot be sufficiently fixed by a non-contact method such as oven fixing or radiant fixing with infrared rays, because of its poor thermal efficiency. Further, when the toner is fixed by a contact fixing method such as a heat-and-pressure fixing method using a heat roller, etc., which is excellent in thermal efficiency and therefore widely used, it becomes necessary to raise the temperature of the heat roller in order to achieve sufficient fixing of the toner, which brings about such disadvantages as a deterioration of the fixing device, a curling of paper and an increase in energy consumption. Furthermore, the resin described above is poor in grindability, thereby remarkably lowering the production efficiency of the toner upon the production of the toner. Accordingly, a binding resin having too high a degree of polymerization and also too high a softening point cannot be used therefor.

Meanwhile, according to the heat-and-pressure fixing method using a heat roller, etc., the surface of a heat roller contacts the surface of a visible image formed on an image-receiving sheet under pressure, so that the thermal efficiency is excellent and therefore widely used in various copying machines from those of high-speed ones to those of low-speed ones. However, when the surface of a heat roller contacts the surface of the visible image, the toner is likely to cause a so-called off-set or offset phenomenon, wherein the toner is adhered to the surface of the heat roller, and thus transferred to a subsequent transfer paper. In order to prevent this phenomenon, the heat roller is treated with a material excellent in release properties, such as a fluororesin, and further a releasing agent such as silicone oil is applied thereon. However, the method of applying a silicone oil, etc. necessitates a larger-scale fixing device, which is not only expensive but also complicated, which in turn may undesirably cause various problems.

Although processes for improving the offset phenomenon by unsymmetrizing or crosslinking the resins have been disclosed in Japanese Patent Examined Publication No. 493/1982 and Japanese Patent Laid-Open Nos. 44836/1975 and 37353/1982, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature of causing high-temperature offsetting as much as possible, the service fixing temperature can be lowered and the serviceable temperature range can be widened, which enables energy saving, high-speed fixing and prevention of the curling of paper.

From the above reasons, the development of a toner excellent in fixing ability and offset resistance has always been desired.

There has been proposed a method for achieving improvement on the low-temperature fixing ability by using a toner comprising a core material and a shell formed thereon so as to cover the surface of the core material.

Among such toners, those having a core material made of a low-melting wax which is easily plastically deformable, as described in U.S. Pat. No. 3,269,626, Japanese Patent Examined Publication Nos. 15876/1971 and 9880/1969, and Japanese Patent Laid-Open Nos. 75032/1973 and 75033/1973, are poor in fixing strength and therefore can be used only in limited fields, although they can be fixed only by pressure.

Further, with respect to toners having a liquid core material, when the strength of the shell is low, the toners tend to break in the developing device and stain the inside thereof, even though they can be fixed only by pressure. On the other hand, when the strength of the shell is high, a higher pressure is necessitated in order to break the capsule, thereby giving too glossy images. Thus, it has been difficult to control the strength of the shell.

Further, there has been proposed, as a toner for heat-and-pressure fixing, a toner of a microcapsule type for heat roller fixing which comprises a core material made of a resin having a low glass transition temperature which serves to enhance the fixing strength, though blocking at a high temperature may take place if used alone, and a shell made of a high-melting point resin which forms a wall by interfacial polymerization for the purpose of imparting blocking resistance, etc. of the toner (see Japanese Patent Laid-Open No. 56352/1986). However, this toner cannot fully exhibit the performance of the core material, because the melting point of the shell material is too high, and also the shell is too tough and not easily breakable. On the same line of thinking as that described above, encapsulated toners for heat roller fixing with an improved fixing strength of the core material have been proposed (see Japanese Patent Laid-Open Nos. 128359/1988, 128360/1988, 128361/1988 and 128362/1988). However, since these toners are prepared by a spray drying method, a higher load to the equipments for the production thereof becomes necessary. In addition, they cannot fully exhibit the performance of the core material, because they have not come up with a solution for the problems in the shell. Further, attempts have been made to control the chargeability of the encapsulated toner in the presence of a charge control agent in the shell of the encapsulated toner or on the surface of the encapsulated toner. However, in the developing process, since the charge control agent becomes detached from the toner due to friction with carrier, etc. and is adhered to the carrier, the electric charge of the resulting toner is lowered, thereby causing such problems as background contamination and scattering of the toner in the developer device. In addition, when no charge control agents are present on the surface of the toner, charging speed may become slow depending upon the type of carriers, thereby causing background contamination, scattering of the toner, etc. in the case of quick printing.

SUMMARY OF THE INVENTION

The present invention has been found under these circumstances, and an object thereof is to provide an encapsulated toner for heat-and-pressure fixing which is excellent in offset resistance, fixable even at a low temperature and excellent in blocking resistance when the encapsulated toner is used for heat-and-pressure fixing using a heat roller, etc.

Another object of the present invention is to provide a method for production of such an encapsulated toner.

Specifically, an object of the present invention is to provide an encapsulated toner for heat-and-pressure fixing, wherein a clear image free from background contamination is stably formed even after a large number of copies by using a resin having a negative charge as a shell material, and to provide a method for production of such an encapsulated toner.

Therefore, in view of solving the above-mentioned problems, the present inventors have investigated an encapsulated toner for heat-and-pressure fixing, and have thus developed the present invention.

More particularly, the present invention essentially relates to an encapsulated toner for heat-and-pressure fixing comprising a heat-fusible core material containing at least a thermoplastic resin and a coloring agent and a shell formed thereon so as to cover the surface of the core material, wherein the shell contains a copolymer having one or more acid anhydride groups as its main components, and a method for production of such an encapsulated toner.

In the present invention, the copolymer having one or more acid anhydride groups is preferably a copolymer obtained by copolymerizing maleic anhydride and styrene, or a copolymer obtained by copolymerizing maleic anhydride, styrene and (meth)acrylate, and more preferably they have glass transition temperatures of not less than 60° C.

Also, in the encapsulated toner, the glass transition temperature assignable to the thermoplastic resin used as the main component of the heat-fusible core material is preferably 10° to 50° C., and the softening point of the encapsulated toner is preferably 80° to 150° C.

DETAILED DESCRIPTION OF THE INVENTION

The encapsulated toner for heat-and-pressure fixing of the present invention is characterized in that its shell contains a copolymer having one or more acid anhydride groups as the main component. Examples of such copolymers having one or more acid anhydride groups include a copolymer obtained by copolymerizing an α,β-ethylenic copolymerizable monomer (A) having an acid anhydride group and the other α,β-ethylenic copolymerizable monomer (B), etc.

Here, examples of the α,β-ethylenic copolymerizable monomers (A) having an acid anhydride group include itaconic anhydride, crotonic anhydride, etc. and the compounds represented by the following formula:

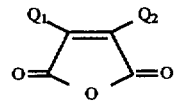

wherein $Q_1$ and $Q_2$ independently represents a hydrogen atom, an alkyl group having 1 to 3 carbon atoms or a halogen atom, which may be exemplified by maleic anhydride, citraconic anhydride, 2,3-dimethylmaleic anhydride, chloromaleic anhydride, dichloromaleic anhydride, bromomaleic anhydride, dibromomaleic anhydride, etc., with a preference given to maleic anhydride, citraconic anhydride, etc.

Examples of the other α,β-ethylenic copolymerizable monomers (B) include styrene and styrene derivatives such as styrene, o-methylstyrene, m-methylstyrene, p-methylstyrene, α-methylstyrene, p-ethylstyrene, 2,4-dimethylstyrene, p-chlorostyrene and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate and phenyl methacrylate; substituted monomers with ethylenic monocarboxylic acids such as acrylonitrile, methacrylonitrile and acrylamide; ethylenic dicarboxylic acids and substituted monomers therewith such as dimethyl maleate; vinyl ketones such as vinyl methyl ketone; vinyl ethers such as vinyl methyl ether; vinylidene halides such as vinylidene chloride. Among these monomers, a preference is given to styrene, (meth)acrylate from the viewpoint of high reactivity.

Preferred examples of such copolymers include a copolymer obtained by copolymerizing maleic anhydride and styrene, a copolymer obtained by copolymerizing maleic anhydride, styrene and (meth)acrylate, a copolymer obtained by copolymerizing citraconic anhydride and styrene, a copolymer obtained by copolymerizing citraconic anhydride, styrene and (meth)acrylate, a copolymer obtained by copolymerizing styrene and acrylonitrile, a copolymer obtained by copolymerizing styrene, (meth) acrylate and acrylonitrile, etc.

The copolymer used in the present invention can be obtained by a copolymerization reaction between 5 to 95 parts by weight of the α,β-ethylenic copolymerizable monomer (A) having an acid anhydride group and 95 to 5 parts by weight of the other α,β-ethylenic copolymerizable monomer (B). The copolymerization reaction can be carried out by conventional addition polymerizations, etc., but it is not limitative to these methods. Also, with respect to each of the monomers (A) and (B), two or more kinds of them may be used to produce a copolymer.

Also, the glass transition temperature of this copolymer is preferably not less than 60° C., more preferably not less than 80° C. When it is less than 60° C., the blocking resistance of the resulting encapsulated toner undesirably decreases.

The copolymer may be used alone or in a combination of two or more kinds.

The content of the copolymer is normally 2 to 50% by weight, preferably 5 to 20% by weight, based on the encapsulated toner. When it is less than 2% by weight, the thickness of the shell formed is insufficient, thereby reducing the blocking resistance of the resulting encapsulated toner. When it exceeds 50% by weight, the strength of the shell becomes too strong, thereby lowering the fixing performance of the resulting encapsulated toner.

The copolymers in the present invention have a negative charge, and the negative charge on the surface of the encapsulated toner can be maintained by using such copolymers as the main component of the shell.

Specifically, by using the copolymer obtained by a copolymerization reaction of acid anhydride group-containing monomers as the main component of the shell, it is possible to stably form clear images free from background contamination for a large number of copies without the detachment of the charge control agent from the toner due to friction with the carrier, etc. Also, it is possible to improve the blocking resistance while maintaining a low-temperature fixing performance.

The resins to be used as the main component of the core materials for the encapsulated toner of the present invention are thermoplastic resins having glass transition temperatures (Tg) of not less than 10° C. and not more than 50° C., and examples thereof include polyester resins, polyester-polyamide resins, polyamide resins and vinyl resins, with a preference given to the vinyl resins.

Examples of the monomers constituting the vinyl resins include styrene and its derivatives such as styrene, o-methylstyrene, m-methylstyrene, p-methylstyrene, α-methylstyrene, p-ethylstyrene, 2,4-dimethylstyrene, p-chlorostyrene and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers with ethylenic monocarboxylic acids such as acrylonitrile, methacrylonitrile and acrylamide; ethylenic dicarboxylic acids and substituted monomersally therewith such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting monomers according to the present invention, it is preferred that styrene or its derivatives is used in an amount of 50 to 90% by weight to form the main chain of the resins, and that the ethylenic monocarboxylic acid or esters thereof is used in an amount of 10 to 50% by weight to adjust the thermal properties such as the softening point of the resin, so that the glass transition temperature of the core material resin can be easily controlled.

When a crosslinking agent is added to the monomer composition comprising the core material-forming resin according to the present invention, any known crosslinking agents may be properly used. Examples thereof include divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate, with a preference given to divinylbenzene and polyethylene glycol dimethacrylate. These crosslinking agents may be used, if necessary, alone or in a combination of two or more.

The amount of these crosslinking agents used is 0.001 to 15% by weight, preferably 0.1 to 10% by weight, based on the copolymerizable monomers. When the amount of these crosslinking agents is more than 15% by weight, the resulting toner is unlikely to be heat-fused, thereby resulting in poor heat fixing ability and heat-and-pressure fixing ability. On the contrary, when the amount is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, etc., two or more polymerization initiators may be used in combination. The amount of the polymerization initiator to be used is 0.1 to 20 parts by weight, preferably 1 to 10 parts by weight based on 100 parts by weight of the monomers to be polymerized.

In the present invention, the charge control agent may be further added to the core material. Negative charge control agents to be added are not particularly limitative, and examples thereof include azo dyes containing metals such as "Varifast Black 3804" (manufactured by Orient Chemical), "Bontron S-31" (manufactured by Orient Chemical), "Bontron S-32" (manufactured by Orient Chemical), "Bontron S-34" (manufactured by Orient Chemical), "Aizenspilon Black TVH" (manufactured by Hodogaya Kagaku), etc.; copper phthalocyanine dye; metal complexes of alkyl derivatives of salicylic acid such as "Bontron E-81" (manufactured by Orient Chemical), "Bontron E-82" (manufactured by Orient Chemical), and "Bontron E-85" (manufactured by Orient Chemical); quaternary ammonium salts such as "Copy Charge NX VP434" (manufactured by Hoechst); nitroimidazole derivatives, etc., with a preference given to Bontron S-34 and Aizenspilon Black TVH.

The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), "Bontron N-11" (manufactured by Orient Chemical), etc.; triphenylmethane dyes containing tertiary amines as side chains; quaternary ammonium salt compounds such as "Bontron P-51" (manufactured by Orient Chemical), cetyltrimethylammonium bromide, "Copy Charge PX VP435" (manufactured by Hoechst); polyamine resins such as "AFP-B" (manufactured by Orient Chemical); imidazole derivatives, etc., with a preference given to Bontron N-01.

The above charge control agents may be contained in an amount of 0.1 to 8.0% by weight, preferably 0.2 to 5.0% by weight, in the core material.

If necessary, the core material may contain one or more arbitrary offset inhibitors for the purpose of improving the offset resistance in the heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

Examples of the above polyolefins include resins such as polypropylene, polyethylene, polybutene, etc., which have softening points of 80° to 160° C. Examples of the above metal salts of fatty acids include metal salts of maleic acid with zinc, magnesium, calcium, etc.; metal salts of stearic acid with zinc, cadmium, barium, lead, iron, nickel, cobalt, copper, aluminum, magnesium, etc.; dibasic lead stearate; metal salts of oleic acid with zinc, magnesium, iron, cobalt, copper, lead, calcium, etc.; metal salts of palmitic acid with aluminum, calcium, etc.; caprylates; lead caproate; metal salts of linoleic acid with zinc, cobalt, etc.; calcium ricinoleate; metal salts of ricinoleic acid with zinc, cadmium, etc.; and mixtures thereof. Examples of the above fatty acid esters include ethyl maleate, butyl maleate, methyl stearate, butyl stearate, cetyl palmitate, ethylene glycol montanate, etc. Examples of the above partially saponified fatty acid esters include partially calcium-saponified montanate, etc. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, etc., and mixtures thereof. Examples of the above higher alcohols include dodecyl alcohol, lauryl alcohol, myristyl alcohol, palmityl alcohol, stearyl alcohol, arachyl alcohol, behenyl alcohol, etc. Examples of the above paraffin waxes include natural paraffins, microwaxes, synthetic paraffins, chlorinated hydrocarbons, etc. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, sorbitan trioleate, etc. Examples of the above silicone varnishes include methylsilicone varnish, phenylsilicone varnish, etc. Examples of the above aliphatic fluorocarbons include oligomers of tetrafluoroethylene, and hexafluoropropylene and fluorinated surfactants disclosed in Japanese Patent Laid-Open No. 124428/1978. Among the above offset inhibitors, a preference is given to the polyolefins, with a particular preference to polypropylene.

It is preferable to use the offset inhibitors in an amount of 1 to 20% by weight based on the resin contained in the core material.

In the present invention, a coloring agent is contained in the core material of the encapsulated toner, and any of the conventional dyes, pigments, etc. which have been used for coloring agents for the toners may be used.

Examples of the coloring agents used in the present invention include various carbon blacks which may be produced by a thermal black method, an acetylene black method, a channel black method, a lamp black method, etc.; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, etc., and mixtures thereof. The coloring agent is usually used in an amount of about 1 to 15 parts by weight based on 100 parts by weight of the resin contained in the core material.

A magnetic encapsulated toner can be prepared by adding a particulate magnetic material to the core material. Examples of the particulate magnetic materials include ferromagnetic metals such as iron, i.e., ferrite and magnetite, cobalt, nickel, etc., alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, a manganese-copper-tin alloy, etc.; chromium dioxide, etc., with a preference given to the compounds containing ferromagnetic materials, and particular preference to magnetite. Such a magnetic material is uniformly dispersed in the core material in the form of a fine powder having an average particle diameter of 0.1 to 1 μm. The content of these magnetic materials is 20 to 70 parts by weight, preferably 30 to 70 parts by weight based on 100 parts by weight of the encapsulated toner.

When a particulate magnetic material is incorporated into the core material in order to make it a magnetic toner, the material may be treated in a similar manner to that of the coloring agent. Since a particulate magnetic material as such is poor in the affinity for organic substances such as core materials and monomers, the material is used together with a known coupling agent such as a titanium coupling agent, a silane coupling agent or a lecithin coupling agent, with a preference given to the silane coupling agent, or is treated with such a coupling agent prior to its use, thereby making it possible to uniformly disperse the particulate magnetic materials.

The method for production of the encapsulated toner for heat-and-pressure fixing of the present invention which comprises a heat-fusible core material containing at least a thermoplastic resin and a coloring agent, and a shell formed thereon so as to cover the surface of the core material, is characterized by the use of a copolymer having one or more acid anhydride groups as the main component of the shell.

In the method for production of the encapsulated toner according to the present invention, the shell can be formed by utilizing such property that when a mixed solution comprising the core material and the shell-forming material containing a copolymer in the present invention as the main component is dispersed in the dispersion medium, the shell-forming material becomes localized on the surface of the liquid droplets. Specifically, the separation of the core material-constituting material and the shell-forming material in the liquid droplets of the mixed solution takes place due to the difference in the solubility indices, and the polymerization proceeds in this state to form an encapsulated structure. By this method, since a shell is formed as a layer containing "a copolymer having one or more acid anhydride groups" as the main component with a substantially uniform thickness, the electric charge of the resulting toner becomes uniform.

In the case of producing the encapsulated toner for heat-and-pressure fixing of the present invention by the above method, a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, aluminum hydroxide, etc., with a preference given to tricalcium phosphate and sodium dodecylbenzenesulfonate. These dispersion stabilizers may be used alone or in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, dioxane, etc., with a preference given to water. These dispersion media can be used singly or in combination.

In the method for production of the encapsulated toner according to the present invention, the in-situ polymerization as described above is preferably carried out from the viewpoint of simplicity in production facilities and production steps. Alternatively, the shell may be formed by a dry method comprising stirring in an air stream at a high rate matrix particles used as a core material together with particles used as a shell-forming material having a number-average particle size of one-eighth or less of that of the matrix particles.

In addition, for the purpose of charge control, the charge control agents exemplified above may be properly added to the shell-forming materials of the encapsulated toner of the present invention. Alternatively, the charge control agent may be used in a mixture with a toner. In such a case, since the shell itself controls chargeability, the amount of these charge control agents, if needed, can be minimized.

According to the present invention, the main component of the heat-fusible core material comprises a thermoplastic resin, and it is preferred that the glass transition temperature assignable to the above resin is not less than 10° C. and not more than 50° C. When the glass transition temperature is less than 10° C., the storage stability of the encapsulated toner becomes poor, and when it exceeds 50° C., the fixing strength of the resulting encapsulated toner becomes undesirably poor. In the present invention, the "glass transition temperature" used herein refers to the temperature of an intersection of the extension of the baseline of not more than the glass transition temperature and the tangential line having the maximum inclination between the kickoff of the peak and the top thereof as determined using a differential scanning calorimeter (Seiko Instruments, Inc.), at a temperature rise rate of 10° C./min.

Further, the softening point of the encapsulated toner of the present invention is preferably not less than 80° C. and not more than 150° C. When the softening point is less than 80° C., the offset resistance of the toner becomes poor, and when it exceeds 150° C., the fixing strength of the resulting encapsulated toner becomes poor. In the present invention, the "softening point" used herein refers to the temperature corresponding to one-half of the height (h) of the S-shaped curve showing the relationship between the downward movement of a plunger (flow rate) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

Although the particle diameter of the encapsulated toner of the present invention is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner of the present invention, a fluidity improver, a cleanability improver, etc. may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil having amine in the side chain thereof, etc. can be used.

The cleanability improvers include fine powders of metal salts of higher fatty acids typically represented by zinc stearate or fluorocarbon polymers, etc.

Further, for the purpose of controlling the developability of the encapsulated toner, finely powdered polymethyl methacrylate or polybutyl methacrylate, etc. may be used.

Furthermore, for the purposes of toning or resistance control, a trace amount of carbon black may be used. The carbon blacks may be those of conventionally known, including various kinds such as furnace black, channel black, acetylene black, etc.

When the encapsulated toner of the present invention contains a particulate magnetic material, it can be used alone as a developer, while when the encapsulated toner does not contain any particulate magnetic material, a binary developer can be prepared by mixing the toner with a carrier. Although the carrier is not particularly limitative, examples thereof include iron powder, ferrite, glass bead, etc., and those of above with resin coatings. The mixing ratio of the toner based on the carrier is 0.5 to 10% by weight. The particle diameter of the carrier is 30 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 190870/1990 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 162356/1990 in which the formed visible images are fixed on a recording medium through a film by using a heating element fixed to a support and a pressing member arranged opposite to the heating element in contact therewith under pressure.

Thus, the encapsulated toner for heat-and-pressure fixing of the present invention has excellent offset resistance and fixing ability even at a low fixing temperature, and also it is excellent in blocking resistance. Further, since the resin having a negative charge is used as a shell material of the encapsulated toner, clear images free from background contamination can be stably formed for a large number of copies.

EXAMPLES

The present invention is hereinafter described in more detail by means of the following working examples, comparative examples and test example, but the present invention is not limited by these examples.

Example 1

7.0 parts by weight of carbon black "#44" (manufactured by Mitsubishi Kasei Corporation), 10.0 parts by weight of a copolymer obtained by copolymerizing maleic anhydride and styrene (molar ratio of maleic anhydride:styrene=1:3; molecular weight: 1900; glass transition temperature: 124.7° C.), and 3.5 parts by weight of 2,2'-azobisisobutyronitrile are added to a mixture comprising 69.0 parts by weight of styrene, 31.0 parts by weight of 2-ethylhexyl acrylate and 0.9 parts by weight of divinylbenzene. The obtained mixture is introduced into an attritor (manufactured by Mitsui Miike Kakoki) and dispersed at 10° C. for 5 hours to give a polymerizable composition. 240 g of this composition is added to 560 g of a 4% by weight aqueous colloidal solution of tricalcium phosphate which is preliminarily prepared in a two-liter separable glass flask. The obtained mixture is emulsified and dispersed with a TK homomixer (manufactured by Tokushu Kika Kogyo) at 5° C. and a rotational speed of 10,000 rpm for 2 minutes. A four-necked glass cap is set on the flask, and a reflux condenser, a thermometer, a nitrogen inlet tube and a stainless steel stirring rod are attached thereto. The resulting flask is placed on an electric mantle heater. Thereafter, the contents are heated to 85° C. and reacted for 10 hours in a nitrogen atmosphere while stirring. After cooling the reaction mixture, the dispersing agent is dissolved into 10%-aqueous hydrochloric acid. The resulting mixture is filtered, and the obtained solid is washed with water, dried under a reduced pressure of 20 mmHg at 45° C. for 12 hours and classified with an air classifier to give the encapsulated toner with an average particle size of 9 μm whose shell comprises a thermoplastic resin having acid anhydride groups.

To 100 parts by weight of this encapsulated toner, 0.4 parts by weight of hydrophobic silica fine powder "Aerozil R-972" (manufactured by Nippon Aerozil Ltd.) is added to obtain the toner of the present invention. This toner is referred to as "Toner 1." The glass transition temperature assignable to the resin contained in the core material is 27.1° C., and the softening point of Toner 1 is 127.2° C.

Example 2

40 parts by weight of styrene-grafted carbon black "GP-E-2" (manufactured by Ryoyu Kogyo), 10 parts by weight of a copolymer obtained by copolymerizing maleic anhydride and styrene (molar ratio of maleic anhydride:styrene=1:4; molecular weight: 3570; glass transition temperature: 108.2° C.), 2.5 parts by weight of 2,2'-azobis(2,4-dimethylvaleronitrile), and 2.5 parts by weight of 2,2'-azobisisobutyronitrile are added to a mixture comprising 52.0 parts by weight of styrene, 32.0 parts by weight of 2-ethylhexyl acrylate and 0.7 parts by weight of divinylbenzene to give a polymerizable composition.

240 g of this composition is added to 560 g of a 4% by weight aqueous colloidal solution of tricalcium phosphate which is preliminarily prepared in a two-liter separable glass flask. The obtained mixture is emulsified and dispersed with a TK homomixer (manufactured by Tokushu Kika Kogyo) at 5° C. and a rotational speed of 10,000 rpm for 2 minutes. A four-necked glass cap is set on the flask, and a reflux condenser, a thermometer, a nitrogen inlet tube and a stainless steel stirring rod are attached thereto. The resulting flask is placed on an electric mantle heater. Thereafter, the contents are heated to 80° C. and reacted for 6 hours in a nitrogen atmosphere while stirring.

After cooling the reaction mixture, the dispersing agent is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm whose shell comprises a thermoplastic resin having acid anhydride groups.

To 100 parts by weight of this encapsulated toner, 0.4 parts by weight of hydrophobic silica fine powder "Aerozil R-972" is added to obtain the toner of the present invention. This toner is referred to as "Toner 2." The glass transition temperature assignable to the resin contained in the core material is 25.2° C., and the softening point of Toner 2 is 116.4° C.

Example 3

20.0 parts by weight of styrene-grafted carbon black "GPT-505P" (manufactured by Ryoyu Kogyo), 10 parts by weight of a copolymer obtained by copolymerizing maleic anhydride, styrene and 2-ethylhexyl acrylate (weight ratio of maleic anhydride:styrene:2-ethylhexyl acrylate=71:17:12; molecular weight: 4250; glass transition temperature: 82° C.), 2.5 parts by weight of 2,2,'-azobis(2,4-dimethylvaleronitrile), and 2.5 parts by weight of 2,2'-azobisisobutyronitrile are added to a mixture comprising 68.0 parts by weight of styrene, 32.0 parts by weight of 2-ethylhexyl acrylate and 0.7 parts by weight of divinylbenzene to give a polymerizable composition.

240 g of this composition is added to 560 g of a 4% by weight aqueous colloidal solution of tricalcium phosphate which is preliminarily prepared in a two-liter separable glass flask. The obtained mixture is emulsified and dispersed with a TK homomixer (manufactured by Tokushu Kika Kogyo) at 5° C. and a rotational speed of 10,000 rpm for 2 minutes. A four-necked glass cap is set on the flask, and a reflux condenser, a thermometer, a nitrogen inlet tube and a stainless steel stirring rod are attached thereto. The resulting flask is placed on an electric mantle heater. Thereafter, the contents are heated to 80° C. and reacted for 6 hours in a nitrogen atmosphere while stirring.

After cooling the reaction mixture, the dispersing agent is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm whose shell comprises a thermoplastic resin having acid anhydride groups.

To 100 parts by weight of this encapsulated toner, 0.4 parts by weight of hydrophobic silica fine powder "Aerozil R-972" is added to obtain the toner of the present invention. This toner is referred to as "Toner 3." The glass transition temperature assignable to the resin contained in the core material is 30.1° C., and the softening point of Toner 3 is 129.6° C.

Comparative Example 1

The same procedure as that of Example 1 is carried out up to the surface treatment step except that no copolymer obtained by copolymerizing maleic anhydride and styrene is used to give a toner. This toner is referred to as "Comparative Toner 1." The glass transition temperature assignable to the resin contained in the core material is 25.8° C., and the softening point of the Comparative Toner 1 is 125.5° C.

Comparative Example 2

The same procedure as that of Example 2 is carried out up to the surface treatment step except that no copolymer obtained by copolymerizing maleic anhydride and styrene is used to give a toner. This toner is referred to as "Comparative Toner 2." The glass transition temperature assignable to the resin contained in the core material is 25.2° C., and the softening point of the Comparative Toner 2 is 118.3° C.

Comparative Example 3

The same procedure as that of Example 3 is carried out up to the surface treatment step except that no copolymer obtained by copolymerizing maleic anhydride, styrene and 2-ethylhexyl acrylate is used to give a toner. This toner is referred to as "Comparative Toner 3." The glass transition temperature assignable to the resin contained in the core material is 27.3° C., and the softening point of the Comparative Toner 3 is 127.6° C.

Comparative Example 4

The same procedure as that of Example 3 is carried out up to the surface treatment step except that a resin having a low glass transition temperature (weight ratio of maleic anhydride:styrene:2-ethylhexyl acrylate=74:17:9; molecular weight: 4485; glass transition temperature: 52° C.) is used as a copolymer to give an encapsulated toner. This toner is referred to as "Comparative Toner 4." The glass transition temperature assignable to the resin contained in the core material is 24.5° C., and the softening point of the Comparative Toner 4 is 103.4° C.

Test Example

A developer is prepared by placing 6 parts by weight of each of the toners obtained in Examples and Comparative Examples and 94 parts by weight of spherical ferrite powder coated with styrene-methyl methacrylate copolymer resin having a grain size of 250 to 400 mesh into an polyethylene container, and mixing the above components by rotation on the roller together with the container at a rotational speed of 150 rpm for 20 minutes. The resulting developer is evaluated with respect to the electric charge, the fixing ability and the blocking resistance.

(1) Electric charge

The electric charge is measured by a blow-off type electric charge measuring device as described below. Specifically, a specific charge measuring device equipped with a Faraday cage, a capacitor and an electrometer is used. First, W (g) (about 0.15 to 0.20 g) of the developer thus prepared is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the specific charge Q/m of this toner can be calculated by the following equation:

$$Q/m\ (\mu c/g)=C\times V/m$$

Here, m is the weight of the toner contained in W (g) of the developer. When the weight of the toner in the developer is defined as T (g) and the weight of the developer as D (g), the toner concentration in the given sample can be expressed as T/D×100(%), and m can be calculated as shown in the following equation:

$$m\ (g)=W\times(T/D)$$

The measurement results under normal conditions of the electric charge of the developer prepared are shown in Table 1.

In addition, the electric charge of the toners after copying 50,000 sheets is measured, and the image quality determined by the extent of background contamination generated during the continuous copying test and the scattering of the toner in the device are also evaluated and shown together in Table 1.

TABLE 1

| | Electric Charge (μc/g) | | Continuous Copying Test | |
|---|---|---|---|---|
| | At Start | After Copying 50,000 Sheets | Image Quality | Toner Scattering in Machine |
| Toner 1 | −20.3 | −20.5 | Good | None |
| Toner 2 | −19.4 | −18.9 | Good | None |
| Toner 3 | −22.5 | −22.0 | Good | None |
| Comparative Toner 1 | −4.3 | +0.3 | Much Contamination | Numerous |
| Comparative Toner 2 | −5.1 | +0.5 | Much Contamination | Numerous |
| Comparative Toner 3 | −4.9 | +0.5 | Much Contamination | Numerous |
| Comparative Toner 4 | −18.6 | −18.1 | Good | Numerous |

(2) Fixing ability

The fixing ability is evaluated by the method as described below. Specifically, each of the developers prepared as described above is loaded on a commercially available photographic copying machine to develop images. The copying machine is equipped with a selene-arsenic photoconductor; a fixing roller having a rotational speed of 255 mm/sec; a fixing device with variable heat-and-pressure and temperature; and an oil applying device being removed from the copying machine. By controlling the fixing temperature from 100° C. to 220° C., the fixing ability of the formed images and the offsetting properties are evaluated. The results are shown in Table 2.

The lowest fixing temperature used herein is the temperature of the fixing roller at which the fixing ratio of the toner exceeds 70%. This fixing ratio of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing ratio from this density value and a density value before the eraser treatment using the following equation.

$$\text{Fixing ratio} = \frac{\text{Image density after eraser treatment}}{\text{Image density before eraser treatment}} \times 100$$

(3) Offset resistance

The offset resistance is evaluated by measuring the temperature of the low-temperature offset disappearing and the temperature of the high-temperature offset generating using the same testing apparatus under the same testing conditions as in the fixing ability test. Specifically, copying tests are carried out by raising the temperature of the heat roller surface at an increment of 5° C. in the range from 100° C. to 220° C., and at each temperature, the adhesion of the toner onto the heat roller surface for fixing is evaluated with naked eyes.

Those toners with poor offset resistance have an insufficient fixing ability to the paper at a low temperature of, for example, around 100° C.; namely, the toners are adhered onto the heat roller surface for fixing. Thus, a low-temperature offset takes place. When the temperature of the heat roller is raised, the toners become easily fixed to the paper, thereby reducing the amount of the toner adhered onto the heat roller surface. The temperature at which no adhesion of the toners on the heat roller surface is observed, namely, the temperature of the low-temperature offset disappearing, is measured. The results are also shown in Table 2. When the temperature is further raised, the toners rather adhere and remain on the heat roller surface, thereby causing a high-temperature offset. This temperature of high-temperature offset generating is also measured. The results are also shown in Table 2.

(4) Blocking resistance

The blocking resistance is determined by evaluating the extent of the generation of agglomeration of particles after allowing the toner to stand under a temperature of 50° C. and a relative humidity of 40% for 24 hours. The results are also shown in Table 2.

TABLE 2

| | Lowest Fixing Temp. (°C.) | Low-Temp. Offset Disappearing Temp. (°C.) | High-Temp. Offset Generating Temp. (°C.) | Blocking Resistance |
|---|---|---|---|---|
| Toner 1 | 125 | 100 | >220 | Good |
| Toner 2 | 123 | 105 | 180 | Good |
| Toner 3 | 130 | 105 | >220 | Good |
| Comparative Toner 1 | 123 | 100 | >220 | Poor |
| Comparative Toner 2 | 120 | 100 | 180 | Poor |
| Comparative Toner 3 | 126 | 100 | >220 | Poor |
| Comparative Toner 4 | 119 | 100 | 180 | Poor |

As is clear from Table 1, with respect to Toners 1 through 3 according to the present invention and Comparative Toner 4, the values for the electric charges are appropriate, showing only a small change of electric charge after continuous copying of 50,000 sheets, and excellent image quality is maintained. However, Comparative Toners 1 through 3 show low values for the electric charges, and their polarity is reversed after continuously copying 50,000 sheets. In addition, when such comparative toners are used, background contamination takes place during continuous copying presumably due to the presence of a large number of reversed charged particles, and scattering of the toners in the copying machine also takes place.

Further, as is clear from Table 2, in the Toners 1 through 3 and Comparative Toners 1 through 4, all of them have low minimum fixing temperatures and wide non-offsetting regions. Also, since Toners 1 through 3 have a shell formed by coating with a copolymer having a glass transition temperature of not less than 60° C. as the main component, they have good blocking resistance. However, since Comparative Toners 1 through 3 have no shell-forming resins and Comparative Toner 4 has a shell comprising a resin having a low glass transition temperature of 52° C., they have poor blocking resistance.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An encapsulated toner for heat- and pressure-fixing comprising a heat-fusible core material containing at least a thermoplastic resin and a coloring agent and a shell formed thereon so as to cover the surface of the core material, wherein said shell consists of a copolymer having one or more carboxylic acid anhydride groups obtained by copolymerizing between 5 to 95 parts by weight of an α,β-ethylenic copolymerizable monomer (A) having a carboxylic acid anhydride group and 95 to 5 parts by weight of an α,β-ethylenic copolymerizable monomer (B) in an amount of 2 to 50% by weight based on the weight of said encapsulated toner, wherein the softening point of said encapsulated toner is 80° to 150° C., wherein the glass transition temperature assignable to the thermoplastic resin used as the main component for the heat-fusible core material is 10° to 50° C., wherein said copolymer having one or more carboxylic acid anhydride groups has a glass transition temperature of not less than 60° C., and wherein said encapsulated toner can be fixed by a heat- and pressure-fixing apparatus.

2. The encapsulated toner for heat-and-pressure fixing according to claim 1, wherein said α,β-ethylenic copolymerizable monomer (A) having a carboxylic acid anhydride group is selected from the group consisting of itaconic anhydride, crotonic anhydride, and the compounds represented by the following formula:

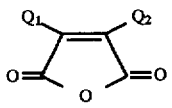

wherein $Q_1$ and $Q_2$ independently represents a hydrogen atom, an alkyl group having 1 to 3 carbon atoms or a halogen atom; and wherein said other α,β-ethylenic copolymerizable monomer (B) is selected from the group consisting of styrene and styrene derivatives, monoolefins, vinyl esters, ethylenic monocarboxylic acids and esters thereof, derivatives of said ethylenic monocarboxylic acids, ethylenic dicarboxylic acids and derivatives thereof, vinyl ketones, vinyl ethers, and vinylidene halides.

3. The encapsulated toner for heat-and-pressure fixing according to claim 2, wherein said copolymer having one or more acid anhydride groups is a copolymer obtained by copolymerizing maleic anhydride and styrene or a copolymer obtained by copolymerizing maleic anhydride, styrene and a (meth)acrylate.

4. The encapsulated toner for heat-and-pressure fixing according to claim 1, wherein said shell has a thickness of 0.01 to 1 μm.

5. The encapsulated toner for heat-and-pressure fixing according to claim 1, obtained by a method comprising:

(a) dissolving a shell-forming resin consisting of a copolymer having one or more carboxylic acid anhydride groups in a mixture comprising a core material-constituting monomer, a coloring agent, and other additives to give a polymerizable composition;

(b) dispersing the polymerizable composition obtained in step (a) in a dispersion medium, and localing the shell-forming resin on the surface of droplets comprising the core material-constituting monomer; and (c) polymerizing the core material-constituting monomer to form the core material covered with the shell, wherein said copolymer having one or more carboxylic acid anhydride groups has a glass transition temperature of not less than 60° C., and is obtained by copolymerizing between 5 to 95 parts by weight of an α,β-ethylenic copolymerizable monomer (A) having a carboxylic acid anhydride group and 95 to 5 parts by weight of an α,β-ethylenic copolymerizable monomer (B).

6. A method for production of an encapsulated toner for heat-and-pressure fixing comprising a heat-fusible core material containing at least a thermoplastic resin having a Tg of 10° to 50° C. and a coloring agent and a shell formed thereon so as to cover the surface of the core material, comprising the steps of:

(a) dissolving a shell-forming resin consisting of a copolymer having one or more carboxylic acid anhydride groups in a mixture comprising a core material-constituting monomer, a coloring agent, and other additives to give a polymerizable composition;

(b) dispersing the polymerizable composition obtained in step (a) in a dispersion medium, and localizing the shell-forming resin on the surface of droplets comprising the core material-constituting monomer; and (c) polymerizing the core material-constituting monomer to form the core material covered with the shell, wherein said shell consists of a copolymer having one or more carboxylic acid anhydride groups in an amount of 2 to 50% by weight based on the weight of said encapsulated toner, said copolymer having a glass transition temperature of not less than 60° C., and being obtained by copolymerizing between 5 to 95 parts by weight of an α,β-ethylenic copolymerizable monomer (A) having a carboxylic acid anhydride group and 95 to 5 parts by weight of an α,β-ethylenic copolymerizable monomer (B).

7. The method according to claim 6, wherein said α,β-ethylenic copolymerizable monomer (A) having a carboxylic acid anhydride group is selected from the group consisting of itaconic anhydride, crotonic anhydride, and the compounds represented by the following formula:

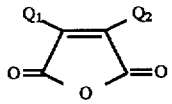

wherein $Q_1$ and $Q_2$ independently represents a hydrogen atom, an alkyl group having 1 to 3 carbon atoms or a halogen atom; and wherein said other α,β-ethylenic copolymerizable monomer (B) is selected from the group consisting of styrene and styrene derivatives, monoolefins, vinyl esters, ethylenic monocarboxylic acids and esters thereof, derivatives of said ethylenic monocarboxylic acids, ethylenic dicarboxylic acids and derivatives thereof, vinyl ketones, vinyl ethers, and vinylidene halides.

8. The method according to claim 7, wherein said copolymer having one or more acid anhydride groups is a copolymer obtained by copolymerizing maleic anhydride and styrene or a copolymer obtained by copolymerizing maleic anhydride, styrene and a (meth)acrylate.

9. The method according to claim 6, wherein one or more dispersion stabilizers are contained in the dispersion medium.

10. The method for production of an encapsulated toner for heat-and-pressure fixing according to claim 6, wherein said encapsulated toner has a softening point of 80° to 150° C.

* * * * *